US008258898B2

(12) United States Patent
Fleege et al.

(10) Patent No.: US 8,258,898 B2
(45) Date of Patent: Sep. 4, 2012

(54) LOW COST MULTI-POLE CIRCUIT BREAKERS WITH SHARED COMPONENTS

(75) Inventors: Dennis W. Fleege, Cedar Rapids, IA (US); Brett Larson, Cedar Rapids, IA (US)

(73) Assignee: Schneider Electric USA, Inc., Palatine, IL (US)

( * ) Notice: Subject to any disclaimer, the term of this patent is extended or adjusted under 35 U.S.C. 154(b) by 369 days.

(21) Appl. No.: 12/619,376

(22) Filed: Nov. 16, 2009

(65) Prior Publication Data

US 2011/0115585 A1 May 19, 2011

(51) Int. Cl.
*H01H 75/00* (2006.01)

(52) U.S. Cl. ..... 335/6; 335/172

(58) Field of Classification Search ..... 200/6
See application file for complete search history.

(56) References Cited

U.S. PATENT DOCUMENTS 3,081,386 A * 3/1963 Pastene et al. ..... 335/9
4,549,153 A * 10/1985 Forsell et al. ..... 335/16
4,616,206 A * 10/1986 Bridges et al. ..... 337/71
4,929,919 A * 5/1990 Link et al. ..... 335/38
4,949,214 A 8/1990 Spencer ..... 361/95
4,992,723 A 2/1991 Zylstra et al. ..... 323/284
5,136,457 A 8/1992 Durivage, III ..... 361/93
5,224,006 A * 6/1993 MacKenzie et al. ..... 361/45
5,250,918 A * 10/1993 Edds et al. ..... 335/35
5,260,676 A * 11/1993 Patel et al. ..... 335/18
5,293,522 A * 3/1994 Fello et al. ..... 335/18
5,301,083 A * 4/1994 Grass et al. ..... 361/64
5,446,431 A * 8/1995 Leach et al. ..... 335/18
5,481,235 A * 1/1996 Heise et al. ..... 335/18
5,483,211 A * 1/1996 Carrodus et al. ..... 335/18
5,691,869 A * 11/1997 Engel et al. ..... 361/42
5,774,319 A 6/1998 Carter et al. ..... 361/93
5,831,509 A * 11/1998 Elms et al. ..... 337/333
5,847,913 A * 12/1998 Turner et al. ..... 361/93.1
5,875,087 A 2/1999 Spencer et al. ..... 361/87
5,946,179 A * 8/1999 Fleege et al. ..... 361/42
6,157,527 A 12/2000 Spencer et al. ..... 361/64
6,212,049 B1 4/2001 Spencer et al. ..... 361/64
6,239,676 B1 * 5/2001 Maloney et al. ..... 335/6
6,242,993 B1 * 6/2001 Fleege et al. ..... 335/18
6,259,340 B1 * 7/2001 Fuhr et al. ..... 335/18
6,356,426 B1 3/2002 Dougherty ..... 361/102
6,477,022 B1 * 11/2002 Ennis et al. ..... 361/42
6,482,048 B1 11/2002 Fleege et al. ..... 439/801

(Continued)

*Primary Examiner* — Elvin G Enad
*Assistant Examiner* — Lisa Homza
(74) *Attorney, Agent, or Firm* — Nixon Peabody LLP

(57) ABSTRACT

A multi-pole circuit breaker comprising a single main housing containing multiple circuit breakers for protecting multiple branch circuits. Each of the circuit breakers comprises a single line terminal for receiving electrical current from a utility line, a plurality of load terminals for supplying electrical current from the single line terminal to a plurality of branch circuits via load lines, and a plurality of neutral terminals for receiving electrical current returned from the branch circuits via neutral lines Line conductors inside the main housing connect the line terminal to the plurality of load terminals. Sensors inside the main housing generate signals representing characteristics of the electrical current flow in the branch circuits, and a signal processor uses the signals generated by the sensors for detecting abnormal conditions in the branch circuits and generating trip signals in response to the detection of an abnormal condition. A single tripping mechanism between the line terminal and the load terminals receives the trip signals and interrupts the flow of current to the branch circuits in response to a trip signal.

9 Claims, 5 Drawing Sheets

U.S. PATENT DOCUMENTS

| | | | | |
|---|---|---|---|---|
| 6,487,057 | B1 * | 11/2002 | Natili | 361/42 |
| 6,532,424 | B1 | 3/2003 | Haun et al. | 702/58 |
| 6,545,574 | B1 * | 4/2003 | Seymour et al. | 335/18 |
| 6,570,255 | B2 * | 5/2003 | Andricacos et al. | 257/758 |
| 6,778,369 | B2 | 8/2004 | Perichon | 361/64 |
| 6,894,594 | B2 * | 5/2005 | Fello et al. | 335/172 |
| 6,924,721 | B2 * | 8/2005 | Afshari et al. | 335/202 |
| 7,030,769 | B2 | 4/2006 | Miller | 340/635 |
| 7,034,241 | B2 | 4/2006 | Fleege et al. | 218/157 |
| 7,054,769 | B2 | 5/2006 | Cox | 702/60 |
| 7,453,267 | B2 | 11/2008 | Westbrock, Jr. et al. | 324/522 |
| 7,463,985 | B2 | 12/2008 | Cox | 702/60 |
| 7,554,320 | B2 | 6/2009 | Kagan | 324/142 |
| 2005/0216131 | A1 | 9/2005 | Sodemann et al. | 700/295 |
| 2008/0212244 | A1 | 9/2008 | Bilac | 361/42 |
| 2009/0174508 | A1 | 7/2009 | Watford et al. | 335/8 |
| 2009/0212630 | A1 | 8/2009 | Flegel et al. | 307/64 |

* cited by examiner

LOW COST MULTI-POLE CIRCUIT BREAKERS WITH SHARED COMPONENTS

FIELD OF THE INVENTION

The present invention relates to multi-pole circuit breakers that use shared components to reduce cost and size.

BACKGROUND

Miniature circuit breakers sold today are usually 1 or 2 pole units, in either 15 or 20 amp configurations (although units with additional poles and other amperages also exist), and can include electronics to provide arcing fault ("AFI") and/or ground fault ("GFI") protection. These circuit breakers are typically sold and packaged as single units, thus requiring stocking of each individual type or version in stores or in warehouses. There is an increasing need for multi-pole circuit breaker assemblies, particularly for residential applications, and thus there is a need for alternatives to the use of multiple 1-pole and/or 2-pole circuit breakers.

BRIEF SUMMARY

The present disclosure provides a multi-pole circuit breaker comprising a single main housing containing multiple circuit breakers for protecting multiple branch circuits. Each of the circuit breakers comprises a single line terminal for receiving electrical current from a utility line, a plurality of load terminals for supplying electrical current from the single line terminal to a plurality of branch circuits via load lines, and a plurality of neutral terminals for receiving electrical current returned from the branch circuits via neutral lines. Line conductors inside the main housing connect the line terminal to the plurality of load terminals. Sensors inside the main housing generate signals representing characteristics of the electrical current flow in the branch circuits, and a signal processor uses the signals generated by the sensors for detecting fault conditions in the branch circuits and generating trip signals in response to the detection of fault conditions. A single tripping mechanism between the line terminal and the load terminals receives the trip signals and interrupts the flow of current to the branch circuits in response to a trip signal.

As used herein, the term "circuit breaker" refers to a device that uses a single tripping mechanism to control the flow of current to two or more branch circuits.

In one implementation, a single ground fault sensor is coupled to conductors located inside the main housing and to the load terminals and neutral terminals for the plurality of branch circuits, for producing a signal representing an imbalance in the current flow in the load and neutral lines for a plurality of branch circuits, and a separate current sensor coupled to each of the branch circuits produces a separate current signal representing characteristics of the current flow in each branch circuit. A single signal processor receives signals from all the ground fault and current sensors to detect the occurrence of a ground fault, overloads or an arcing fault in any of the plurality of branch circuits. If desired, voltages and other operating conditions may also be monitored and used to control the tripping operations.

BRIEF DESCRIPTION OF THE DRAWINGS

The invention may best be understood by reference to the following description taken in conjunction with the accompanying drawings, in which.

DETAILED DESCRIPTION

Although the invention will be described in connection with certain preferred embodiments, it will be understood that the invention is not limited to those particular embodiments. On the contrary, the invention is intended to cover all alternatives, modifications, and equivalent arrangements as may be included within the spirit and scope of the invention as defined by the claims.

Figure 1:
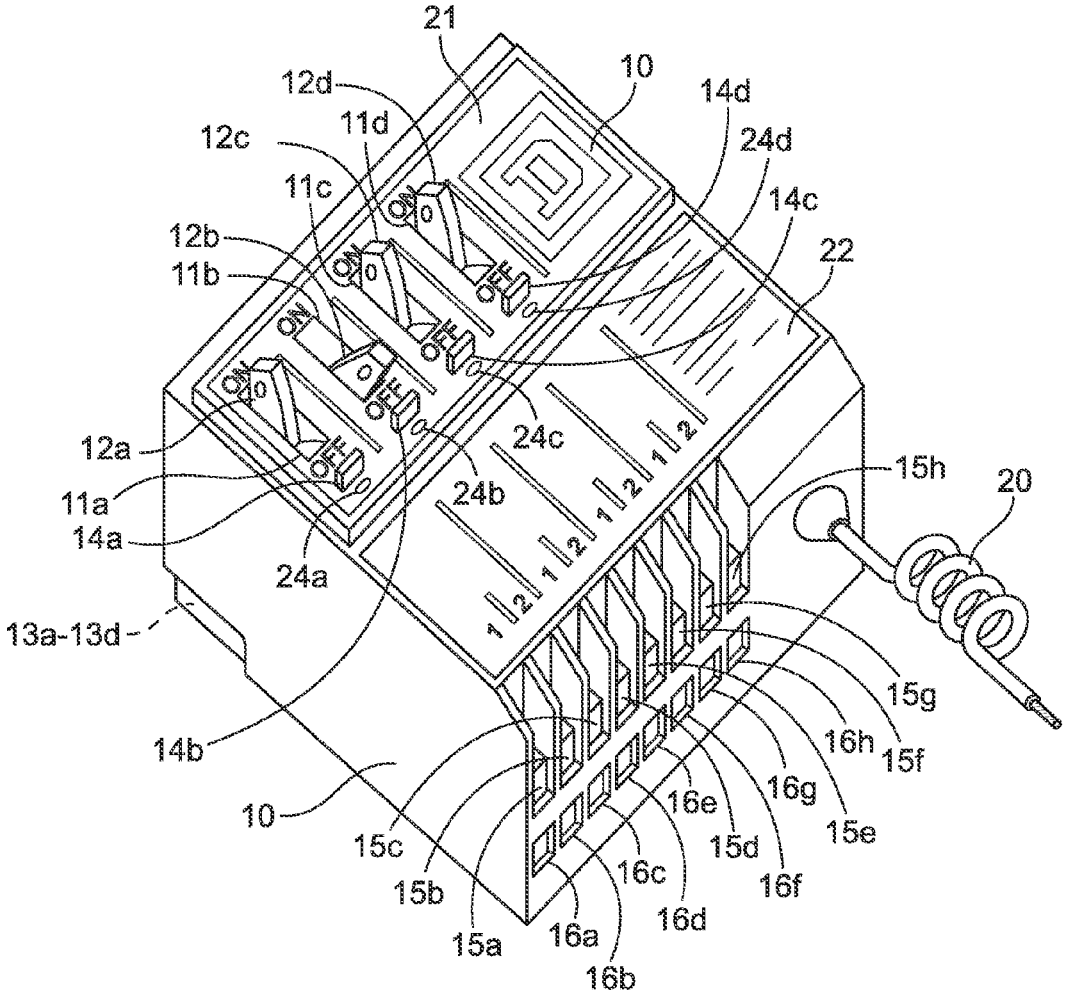
FIG. 1 is a perspective view of four miniature circuit breakers joined together in a single housing to form an 8-pole circuit breaker assembly.

Turning now to the drawings and referring first to FIG. 1, four miniature circuit breakers are integrated in a single housing 10 to form an 8-pole circuit breaker assembly. The housing 10 includes four apertures 11*a*-11*d* that receive four handles 12*a*-12*d* for opening and closing the four circuit breakers inside the housing. In addition, the housing 10 includes four line terminals 13*a*-13*d* for receiving power from the utility lines, and four push-to-test buttons 14*a*-14*d* for testing the four circuit breakers. On the load side, the housing 10 includes eight load terminals 15*a*-15*h* for supplying power to eight branch circuits, i.e., two branch circuits per circuit breaker, and eight neutral terminals 16*a*-16*h* for receiving the neutral return lines from the eight branch circuits. Although the illustrative embodiment uses four circuit breakers to control the current flow in eight branch circuits, it will be understood that other configurations may be used with different numbers of circuit breakers and/or branch circuits, and different numbers of branch circuits controlled by each circuit breaker.

Inside the housing 10, the two neutral lines associated with each circuit breaker are joined to a single neutral conductor 17 (see FIG. 2A) that is passed through a single ground fault sensor (discussed in more detail below), and then connected internally to a neutral conductor 18 that is common to all the circuit breakers in the housing 10. This common neutral conductor 18 exits the housing 10 and forms a neutral pigtail 20 for connection to a neutral bar (not shown) in a load center. Any of the other standard connectors may be used in place of the pigtail.

The front of the housing 10 forms a pair of shallow recesses for receiving a pair of face plate labels 21 and 22. Included in the face plate labels are circuit traces and electronic components such as the push-to-test (PTT) buttons 14*a*-14*d* and LEDs 24*a*-24*d*, which may be used to indicate the trip status of each of the four circuit breakers. The labels 21 and/or 22 may include a dome switch (not shown) for each pole position. The LEDs 24*a*-24*d* may be illuminated to show the cause of a breaker trip (e.g., overload, ground fault, arcing fault, or the use of a PTT button) or to indicate which of the branch circuits associated with a common breaker caused the tripping of that breaker. For example, an LED may be illuminated continuously or intermittently in one or more colors to indicate which branch circuit caused the tripping of a given breaker.

Figure 2A:
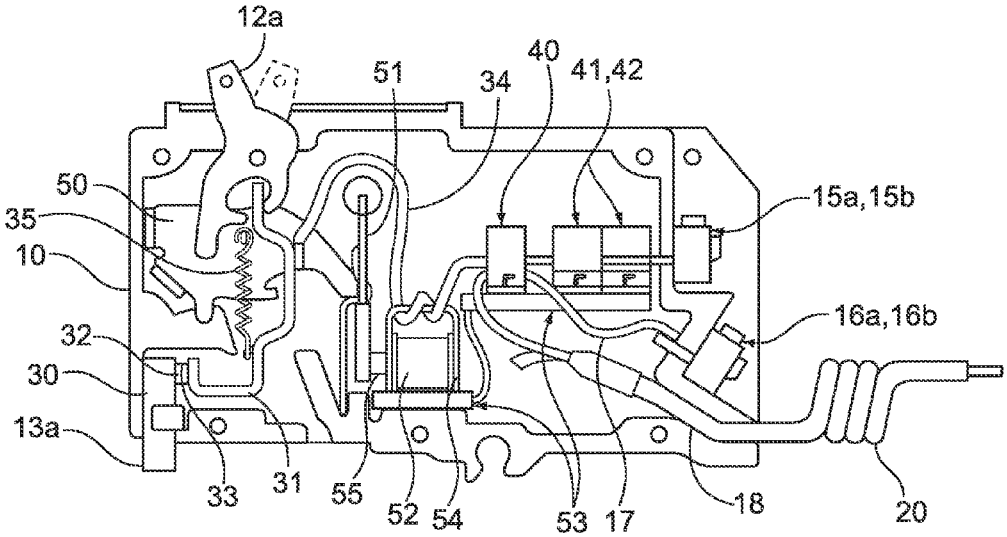
FIG. 2A is an enlarged vertical section of one embodiment of the miniature circuit breakers used in the housing shown in FIG. 1.

FIG. 2A illustrates the internal structure of one of the circuit breakers inside the housing 10, e.g., the circuit breaker having the handle 12*a*. Power is routed through the circuit breaker via the line terminal 13*a* and the load terminals 15*a* and 15*b*. As depicted in FIG. 2A, the circuit breaker is in a closed position, enabling current to flow through the circuit breaker. The current path through the circuit breaker extends from the line terminal 13*a*, formed by a stationary contact carrier 30, to the load terminals 15*a* and 15*b*. In the closed position, current flows from the line terminal 13*a* to the movable contact carrier 31 via stationary and movable contacts 32 and 33, respectively. From the movable contact carrier 31, a line conductor 34 having bifurcated load-end portions 34*a*, 34*b* (see FIG. 5) conducts current to the load terminals 15*a* and 15*b*. Current flows out of the load end of the circuit breaker via the load terminal 15*a* and 15*b*, through a pair of branch circuits, and returns through a pair of neutral lines to the neutral terminals 16*a* and 16*b*.

From the movable contact carrier 31, the line conductor 34 conducts the current through a single ground fault sensor 40 that is common to both branch circuits, and then the bifurcated portions 34*a* and 34*b* conduct current through a pair of parallel arcing fault or current sensors 41 and 42 to the two load terminals 15*a* and 15*b*. The current path them proceeds from the load terminals 15*a* and 15*b* to the field loads by means of field wiring (not shown).

After the current has gone through the field loads, it returns to the circuit breaker via neutral wires (not shown) which are connected to the neutral terminals 16*a*, 16*b*, and is then carried by the single neutral conductor 17 through the ground fault sensor 40 to the common neutral conductor 18 for all the neutral wires in the housing 10. The conductor 18 exits the housing 10 and forms the neutral pigtail 20. Since multiple poles are combined into one housing, only the one common neutral pigtail 20 (or other standard connector) is needed outside the housing, which further reduces the cost of the assembly.

The illustrative circuit breaker includes an actuating mechanism that opens and closes the contacts 32 and 33. For the open position, the movable contact carrier 31 is rotated away from the stationary contact 32, causing the movable contact 33 to separate from the stationary contact 32. When the contacts 32 and 33 separate, current no longer flows from the line terminal 13*a* to the load terminals 15*a* and 15*b*. The circuit breaker may be tripped open in any of several ways, including manual control or in response to an abnormal condition such as a short circuit, an overload, arcing fault or ground fault.

The movable contact carrier 31 may be moved between the open and closed positions by a user manually moving the handle 12*a* to the right or left, respectively, causing corresponding movement of the upper end of the movable contact carrier 31 to the left or right of a pivot point. A spring 35 is connected at one end to trip lever 50 and at another end to the bottom of the movable contact carrier 31. When the upper end of the movable contact carrier 31 is left of the pivot point, the spring 35 biases the bottom of the movable contact carrier 31 to the open position. Conversely, when the upper end of the movable contact carrier 31 is right of the pivot point, the spring 35 biases the bottom of the movable contact carrier 31 to the closed position.

In the closed position, the trip lever 50 is latched by engagement with an armature 51. The trip lever 50 is pivotally mounted about a pivot at one end. The other end of the trip lever 50 is seated in a latched position on the armature 51. The spring 35 connects the trip lever 50 to the movable contact carrier 31, and biases the movable contact 33 against the stationary contact 32. To trip the breaker, a solenoid 52 is energized to move the armature 51 to unlatch the trip lever 50. The trip lever 50 then swings clockwise to its tripped position, carrying the upper end of the spring 35 to the opposite side of its dead center position. The spring 35 rotates the movable contact carrier 31 from the closed circuit position to the open circuit position, separating the movable contact 33 from the stationary contact 32.

The circuit breaker is provided with circuitry 53 to trip the breaker in response to an arcing fault, ground fault or overload. The trip circuitry 53, which typically includes signal processing circuitry (usually in the form of a signal processor), is formed on a printed wiring assembly (PWA, which is a printed circuit board having multiple components mounted on it) 54 mounted within the housing 10. When the circuitry detects any of these abnormal conditions, it generates a trip signal to energize the solenoid 52.

To detect the occurrence of a ground fault when the contacts 32 and 33 are closed, the ground fault sensor 40 detects any difference between the currents in the line conductor 34 and the neutral conductor 17 and provides a signal representing any such difference to the trip circuitry 53. The neutral conductor 17 and the line conductor 34 are both routed through the ground fault sensor 40 to permit sensing of any such imbalance of current flow in the line and neutral conductors. If the imbalance exceeds the trip level of the ground fault detection circuitry, the trip circuitry 53 sends a trip signal to energize the solenoid 52 to trip the circuit breaker.

One example of a ground fault detection circuit is described in U.S. Pat. No. 7,193,827, and an improved sensor utilizing that circuit is described in copending application Ser. No. 12/267,750 filed Nov. 10, 2008, both of which are assigned to the assignee of the present invention and are incorporated herein by reference in their entirety. The detection circuit described in U.S. Pat. No. 7,193,827 detects both ground faults and grounded neutrals with only a single current sensor.

To detect the occurrence of an arcing fault when the contacts 32 and 33 are closed, the bifurcated portions 34*a* and 34*b* of the line conductor 34 pass through the arcing fault or current sensors 41 and 42 to monitor the currents supplied to the two branch circuits via the load terminals 15*a* and 15*b*. Signals from the sensors 41 and 42, preferably representing the respective rates-of-change of the currents, are supplied to the trip circuitry 53 mounted on the printed circuit board. The arcing fault detection circuitry in the trip circuitry 53 analyzes the signal for characteristics of an arcing fault. If the arcing fault detection circuitry detects the presence of an arcing fault, it sends a trip signal to energize the solenoid 52 to trip the circuit breaker.

The patterns of the fluctuations in the signals produced by the arcing fault or current sensors 41 and 42 indicate whether the associated branch circuits are in normal operating condition or an arcing fault condition. Examples of suitable arcing fault sensors and arcing fault detection circuitry or signal processors are described in U.S. Pat. Nos. 6,259,996, 7,151,656, 7,068,480, 7,136,265, 7,253,637 and 7,345,860, owned by the assignee of the present invention, which are incorporated herein by reference in their entirety.

To detect the occurrence of an overload when the contacts 32 and 33 are closed, an overload detection portion of the trip circuitry 53 samples the current flowing through the line conductor 34. The overload detection circuitry analyzes the current samples for characteristics of an overload, and if an overload is detected, the trip circuitry 53 sends a trip signal to energize the solenoid 52 to trip the circuit breaker in the same fashion as described above. Overload detection circuitry typically simulates the bimetal deflection of traditional circuit breakers, as described in U.S. Pat. No. 5,136,457, assigned to the assignee of the present invention and incorporated herein by reference in its entirety. To simulate bimetal deflection, the overload circuitry accumulates the squared values of current samples taken from the line conductor 34. The sum of the squared values of that current is proportional to the accumulated heat in the tripping system. The overcurrent circuitry decrements logarithmically the accumulated square of the current to account for the rate of heat lost due to the temperature of the power system conductors being above ambient temperature. When the accumulating value exceeds a predetermined threshold representing the maximum allowed heat content of the system, the trip circuitry 53 sends a trip signal to energize the solenoid 52 to trip the circuit breaker.

Figure 2B:
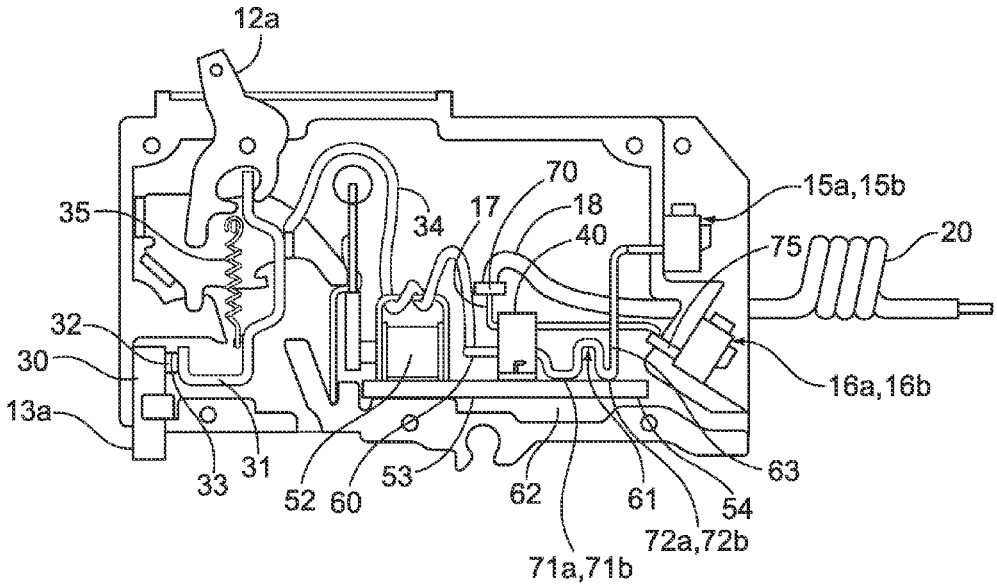
FIG. 2B is an enlarged vertical section of a modified embodiment of the miniature circuit breakers used in the housing shown in FIG. 1.
Figure 3:
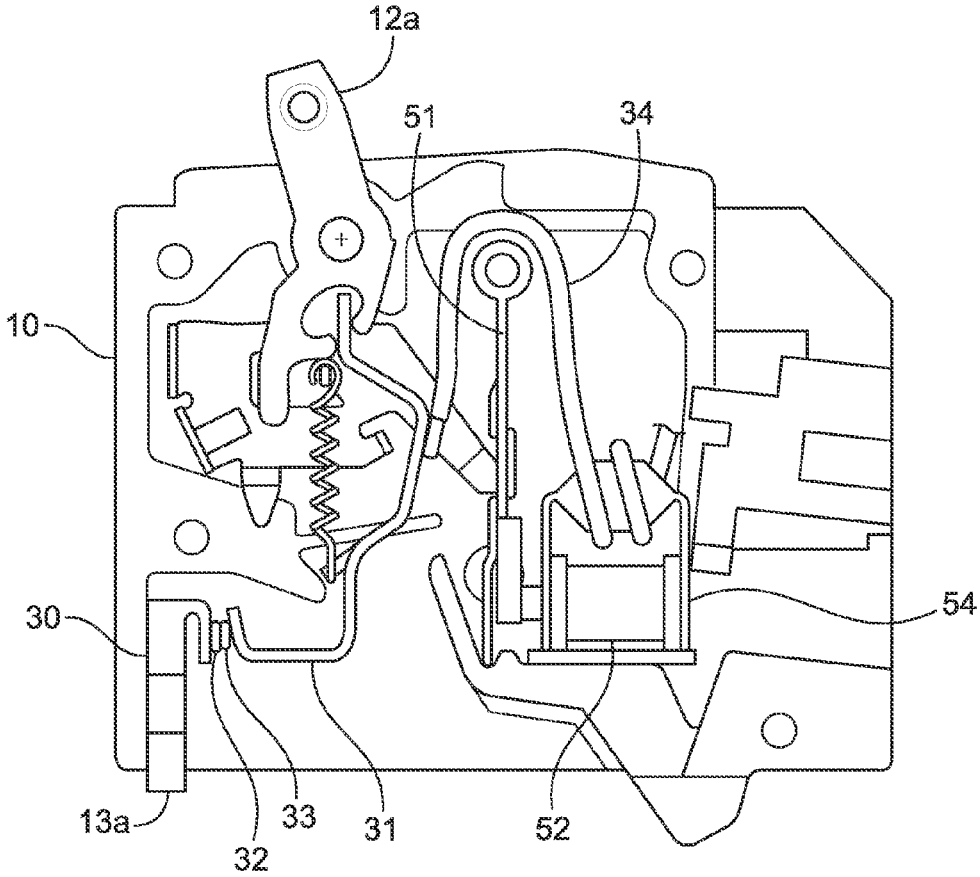
FIG. 3 is an enlarged side elevation of the tripping solenoid and mechanism in the circuit breakers of FIGS. 2A and 2B.

To produce a faster trip when the current in the load line increases significantly, such as in the case of a short circuit, the line conductor 34 is wrapped around (two turns) the frame 54 of the tripping solenoid 52 to induce a magnetic loop (see FIGS. 2A, 2B and 3). In the event of a short circuit, this loop causes the plunger 55 of the tripping solenoid 52 to quickly retract into the body of the solenoid, thereby producing an immediate trip. The plunger 55 pulls on the end of the armature 51, thus releasing the trip lever 50, causing the mechanism to trip and open the contacts 32 and 33. Two turns of the conductor are wrapped around the frame 54 in FIGS. 2A, 2B and 3, but any number of turns may be utilized.

FIG. 2B illustrates a modified embodiment in which the line conductor 34 is routed from the solenoid frame 54 to a stamped conductor 60 that extends through the ground fault sensor 40. On the load side of the sensor 40, the stamped conductor 60 splits to form a pair of resistive sensors that are attached to the PWA at 71*a*, 71*b* and 72*a*, 72*b* before being connected to the load terminals 15*a*, 15*b*, respectively.

Figure 4:
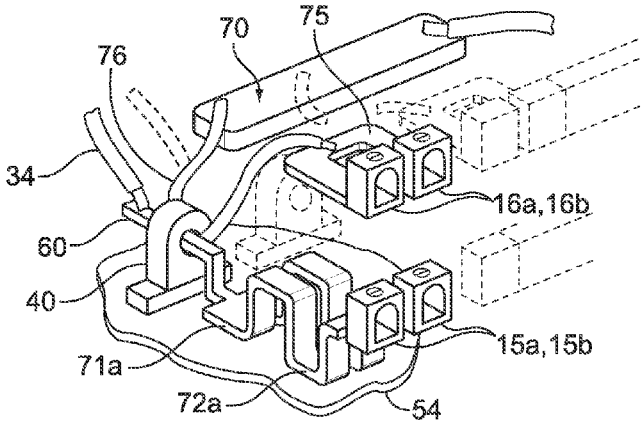
FIG. 4 is an enlarged perspective of a portion of a modified printed wire assembly for use in the circuit breaker of FIG. 2B.

FIG. 4 illustrates the stamped conductor 60 in more detail, connecting the line conductor 34 to the load terminals 15*a* and 15*b*. The conductor 60 passes through the ground fault sensor 40 and is then split into two branches for connection to the two load terminals 15*a* and 15*b*. Between the sensor 40 and the terminals 15*a*, 15*b*, the bifurcated portion of the stamped conductor 60 is connected to the PWA 54 at 71*a*, 71*b* and 72*a*, 72*b* and loops upwardly from the PWA between the two connection points 71 and 72 to provide a desired length of material, i.e., a desired resistance, in the space available between the sensor 40 and the terminals 15*a* and 15*b*. During an overload condition in one of the branch circuits, the current flow through the corresponding branch of the conductor 60 increases, which increases the voltage drop across that portion of the conductor. When the voltage drop exceeds a predetermined threshold, the trip circuitry 53 sends a trip signal to energize the solenoid 52 to trip the circuit breaker.

The neutral wires from the branch circuits are connected to the neutral terminals 16*a* and 16*b* that have a common connector plate 75 connected to the neutral conductor 17 that passes through the ground fault sensor 40 to a common neutral bar 70 that receives the neutral wires from all the branch circuits.

Figure 5A:
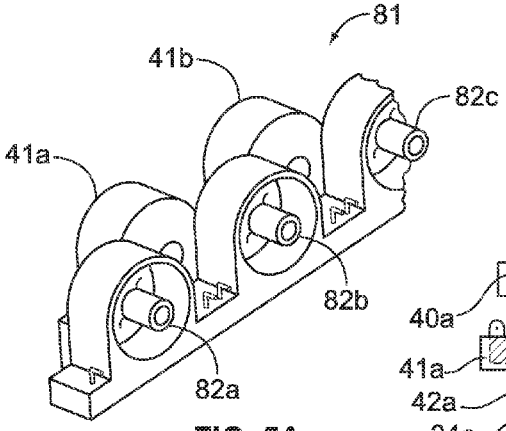
FIG. 5A is an exploded perspective of a modified embodiment of an AFI/current sensor for use as an alternative to the sensor shown in FIG. 4.
Figure 5B:
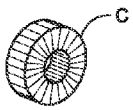
FIG. 5B is a perspective view of a coil to be received in one of the cavities of the housing of FIG. 5A.
Figure 5C:
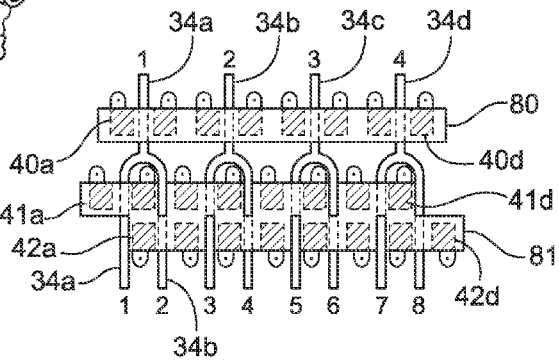
FIG. 5C is a top plan view of the AFI/current sensor of FIG. 5A combined with a modified ground fault sensor.

FIGS. 5A, 5B and 5C illustrate an arrangement of four ground fault sensors 40*a*-40*d* and eight arcing fault/current sensors 41*a*-41*d* and 42*a*-42*d* for all four of the circuit breakers in the housing 10. The coils C of the four ground fault sensors 40*a*-40*d* are contained in cavities formed by a unitary molded plastic housing 80 that has hollow posts aligned with the centers of four coils C for passing the four line conductors 34*a*-34*n* and the corresponding neutral conductors (not shown). The coils C of the eight arcing fault/current sensors 41*a*-41*d* and 42*a*-42*d* are contained in two sets of four cavities formed in opposite sides of a unitary molded plastic housing 81 that has hollow posts 82*a*-82*h* aligned with the centers of eight coils C for passing the bifurcated end portions of the four line conductors 34*a*-34*d*. The two sets of cavities formed by the housing 81 are offset from each other so that the conductors that pass between the coils C in the first set of cavities are positioned to pass through the centers of the coils C in the second set of cavities.

Figure 6:
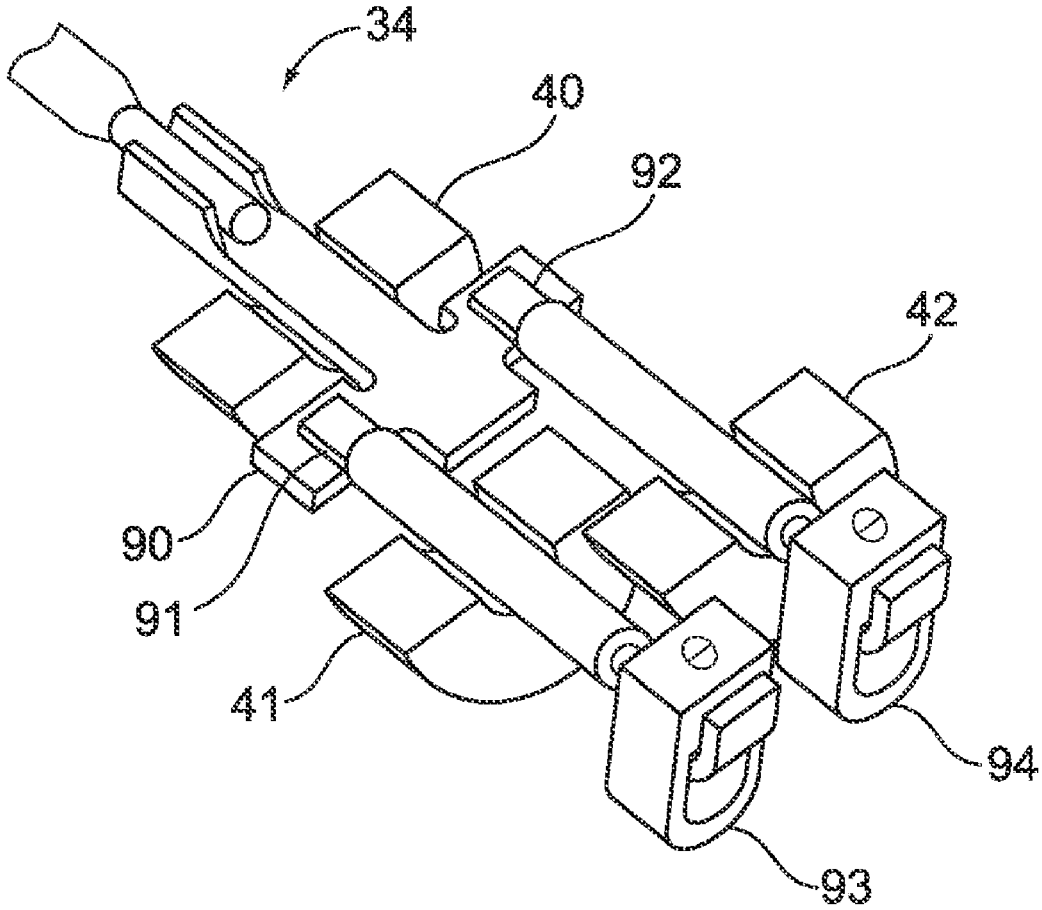
FIG. 6 is a sectioned perspective of another modified GFI and AFI/current sensor structure.

FIG. 6 illustrates a modified embodiment of that portion of a line conductor 34 that passes through a single ground fault sensor 40 and a pair of arcing fault/current sensors 41 and 42. The portion of the conductor 34 that passes through the ground fault sensor 40 is formed by a flat T-shaped plate 90, and the bifurcated portion of the conductor that passes through the two arcing fault/current sensors 41 and 42 is formed by a pair of insulated flat plates 91 and 92 that are connected at one end to the two arms of the T-shaped plate 90 and are connected at the other end to a pair of lugs 93 and 94.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

The invention claimed is:

1. A multi-pole circuit breaker assembly comprising a single main housing containing multiple circuit breakers each of which is connected to multiple branch circuits, each of said circuit breakers having a single line terminal for receiving electrical current from a utility line, a plurality of load terminals for supplying electrical current from said single line terminal to said multiple branch circuits via load lines, line conductors inside said main housing for connecting said line terminal to said plurality of load terminals, a plurality of neutral terminals for receiving electrical current returned from said multiple branch circuits via neutral lines, a separate arcing fault sensor coupled to a separate line conductor connected to each of said load terminals for generating a separate signal representing characteristics of the electrical current flow in each of said multiple branch circuits, signal processing circuitry receiving said signals for detecting fault conditions in said multiple branch circuits and generating trip signals in response to the detection of fault conditions, and a single tripping mechanism between said line terminal and said load terminals for receiving said trip signals and interrupting the flow of current to said multiple branch circuits in response to a trip signal.

2. The multi-pole circuit breaker assembly of claim 1 in which said sensors in each of said circuit breakers include a single ground fault sensor coupled to conductors located inside said housing and coupled to said load terminals and to said neutral terminals for said plurality of branch circuits, said ground fault sensor producing a signal representing an imbalance in the current flow in said load and neutral lines for said plurality of branch circuits, and separate current sensors coupled to said line conductors for said plurality of branch circuits, said current sensors producing separate current signal representing characteristics of the current flow in each of said plurality of branch circuits, and said signal processing circuitry receives said signals from said ground fault sensor and said current sensors to detect the occurrence of a ground fault, an overload or an arcing fault in any of said plurality of branch circuits.

3. The multi-pole circuit breaker of claim 2 which includes a unitary molded plastic housing located inside said main housing for holding said ground fault sensors for said multiple circuit breakers.

4. The multi-pole circuit breaker of claim 2 which includes a unitary molded plastic housing located inside said main housing for holding said current sensors for said multiple circuit breakers.

5. The multi-pole circuit breaker assembly of claim 2 in which said neutral terminals of each circuit breaker are connected to a common neutral conductor inside said housing, said common neutral conductor passing through said single ground fault sensor associated with that circuit breaker.

6. The multi-pole circuit breaker of claim 1 which includes a common neutral connector inside said housing for joining neutral conductors from all of said neutral terminals, and a neutral pigtail connected to said common neutral connector and extending outside said housing for connection to a neutral bar in a load center.

7. The multi-pole circuit breaker of claim 1 which includes external indicators on said housing for identifying the branch circuit in which an abnormal condition occurred.

8. The multi-pole circuit breaker of claim 1 which includes external indicators on said housing for identifying the cause of a circuit breaker trip.

9. The multi-pole circuit breaker of claim 1 in which each of said line conductors inside said main housing is bifurcated for coupling to said plurality of load terminals.

* * * * *